United States Patent [19]

Erickson

[11] 4,177,368

[45] Dec. 4, 1979

[54] SWITCH OPERATING ROD ASSEMBLY

[75] Inventor: James A. Erickson, Crystal Lake, Ill.

[73] Assignee: Boltswitch, Inc., Crystal Lake, Ill.

[21] Appl. No.: 924,943

[22] Filed: Jul. 17, 1978

[51] Int. Cl.[2] ..... H01H 3/02

[52] U.S. Cl. ..... 200/332; 200/335; 74/519; 85/5 N; 403/155; 403/157

[58] Field of Search ..... 200/335, 332; 74/519; 85/8.8, 5 N, 5 CP; 403/154, 155, 157

[56] References Cited

U.S. PATENT DOCUMENTS 3,604,879 9/1971 Beer ..... 200/335

*Primary Examiner*—Houston S. Bell, Jr.
*Attorney, Agent, or Firm*—Kinzer, Plyer, Dorn & McEachran

[57] ABSTRACT

A high-current, low-voltage load-break switch of the type having a plurality of fixed contacts and a plurality of movable contacts. Each of the movable contacts moves between a closed position in bolted pressure contact with one of the fixed contacts and a open position which is displaced from its fixed contact. An actuating bar connects the movable contacts for movement of the contacts in unison. A switch-operator mechanism is provided for rapidly closing the switch by driving the movable contacts to their closed positions and also to their open positions. An electrically non-conductive operating rod assembly is provided for connecting the actuating bar and the switch-operator mechanism. This rod assembly includes an elongated metal rod having threads at its opposite ends. One end of the rod is threaded to a first metal yoke which is pivotally connected to one end of an insulator link. The insulator link is pivotally connected to an operating lever formed as part of the switch-operator mechanism. The opposite end of the elongated rod is threaded to a second metal yoke. The second metal yoke is pivotally connected to one end of a second insulator link. The second insulator link is pivotally connected at its opposite end to a bracket which is affixed to the actuating bar for the movable contacts.

3 Claims, 3 Drawing Figures

SWITCH OPERATING ROD ASSEMBLY

BACKGROUND OF THE INVENTION

This invention relates to an electrically non-conductive operating rod assembly for a bolted-pressure contact switch and particularly to an operating rod assembly which utilizes a threaded metal rod and insulator links of molded high-strength dielectric material.

Fused load-break switches are frequently used as service entrance equipment and in other relatively high current applications. Typically, multiple-pole switches of this kind may be required to interrupt currents of 400–20,000 amperes. These switches are rated for 208,240,480 or 600 volt service. While 600 volt service is not common, a switch rated for this service provides a greater safety margin when used in lower voltage installations.

Most switches of the load-break type are provided with positive pressure applying mechanisms for assuring good contact between the switch terminals. The contacts of these switches are opened and closed rapidly to minimize arcing and thereby avoid pitting and deterioration of the switch contacts. Rapid opening and closing of the switch contacts have been accomplished by the use of an overcenter spring drive. The spring drive can be energized and the switch actuated by manual or electrical means. The manual or electrical means is not used directly to open or close the switch contacts but, instead, operates a trip mechanism to release the spring drive. The overcenter spring drive and its actuating means is commonly referred to as the switch operator mechanism.

The switch operator mechanism is located away from the switch contacts so as to be out of the arcing zone of the contacts. The switch operator mechanism is connected to the contacts by an operating rod assembly and a crossbar. The crossbar, which is made of an insulating material, is connected to the movable contacts. The operating rod assembly is connected to a bracket affixed to the crossbar. In the past, the operating rod has been of a fixed length and formed from laminated strips of phenolic impregnated cloth. Operating rods of this previous construction have presented problems in manufacturing and assembling and did not provide any flexibility of adjustment to compensate for misalignment of the parts of the switch.

SUMMARY OF THE INVENTION

It is an object of the present invention, therefore, to provide an electrically non-conductive operating rod assembly for a bolted-pressure contact switch which is stronger and more durable than operating rods presently used with such switches.

A further object of this invention is to provide a non-conductive operating rod assembly for a bolted-pressure contact switch which is adjustable in length and during operation automatically compensates for any misalignment of the operating parts of the switch.

A related object of the invention is an electrically non-conductive operating rod assembly formed of machined metal parts for strength and insulator links of molded high-strength dielectric material for electrical insulating purposes.

Another object of the invention is an electrically non-conductive operating rod assembly which is less expensive to manufacture and assemble than present operating rods.

Accordingly, the invention relates to an electrically non-conductive operating rod assembly for a high current, low-voltage, load-break switch of the type which has a number of fixed contacts and a corresponding number of movable contacts connected by an actuating bar. The movable contacts are movable in unison between closed positions in bolted pressure contact with the fixed contacts and open positions displaced from the fixed contacts. A switch operator mechanism is provided for rapidly opening and closing the switch by driving the movable contacts to their closed positions and also to their open positions. An electrically non-conductive operating rod assembly connects the switch operator and the movable contacts actuating bar. The electrically non-conductive operating rod assembly includes an elongated metal rod having threads at its opposite ends. One end of the rod threads into a first metal yoke. The first metal yoke is pivotally connected to one end of an insulator link of molded high-strength dielectric material. The insulator link is pivotally connected to an operating lever formed as part of the switch operator mechanism. The opposite end of the rod threads into a second metal yoke. The second metal yoke is pivotally connected to a second insulator link of molded high-strength dielectric material. The second insulator link is pivotally connected at its opposite end to a bracket which is affixed to the movable contact actuating bar.

DESCRIPTION OF THE PREFERRED EMBODIMENT

Figure 1:
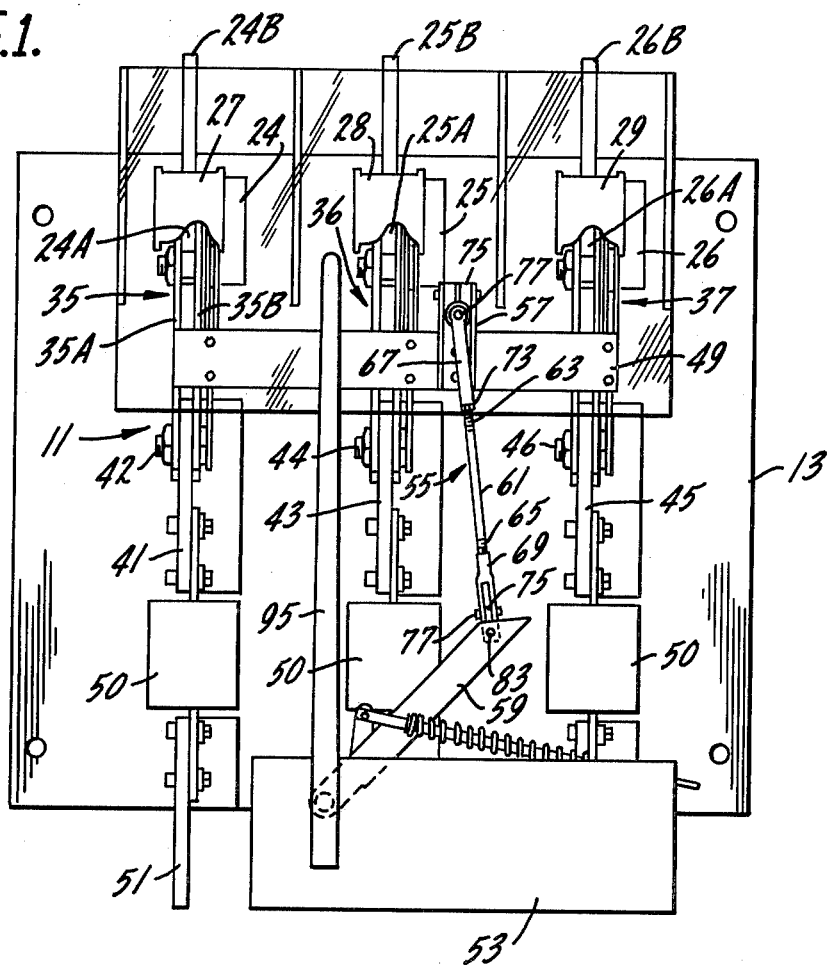
FIG. 1 is a front elevational view of a load-break switch equipped with an electrically non-conductive operating rod assembly constructed in accordance with the present invention, the switch itself being of known construction.
Figure 2:
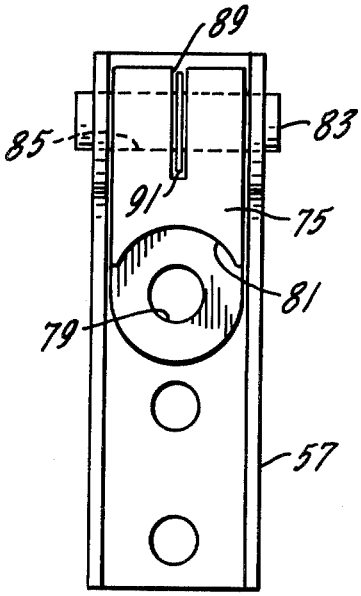
FIG. 2 is an enlarged front elevational view of the operating rod connecting link showing its connection to the crossbar bracket.
Figure 3:
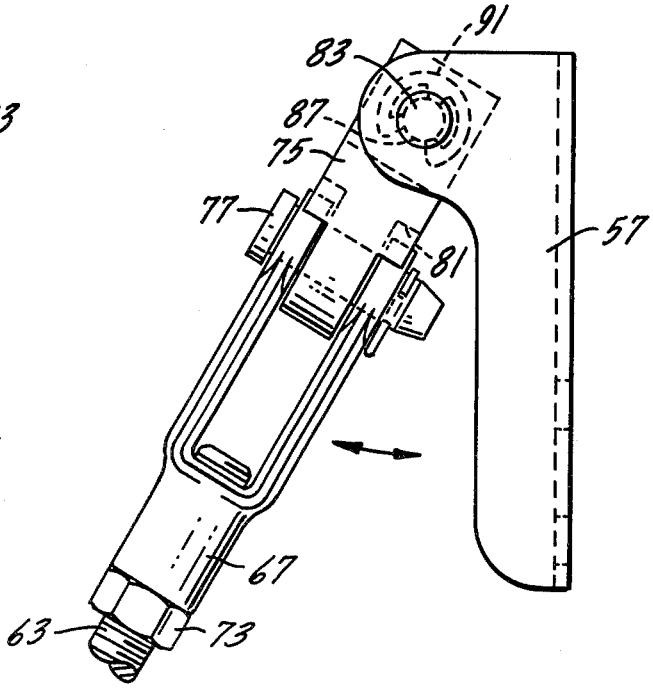
FIG. 3 is an enlarged partial side elevational view of the portion of the operating rod assembly which is connected to the crossbar bracket.

FIG. 1 of the drawings illustrates a high-current, low-voltage, load-break switch 11 mounted on a base 13 of insulating material. The switch is normally installed in a metal housing but the housing has not been shown for clarity of illustration.

Across the top of the insulating base 13, there are mounted three fixed contacts 24, 25 and 26 provided with outwardly projecting contact blades 24A, 25A and 26A, respectively; each fixed contact may be provided with an individual terminal lug 24B, 25B and 26B, respectively. Three arc chutes 27, 28 and 29 are mounted on the fixed contacts 24, 25 and 26, respectively. A suitable arc chute is shown in U.S. Pat. No. 3,441,699, but the invention should not be limited to the use of the particular arc chute shown in that patent since that arc chute is merely illustrative of one of a number of different forms of arc chutes which may be used.

Each of the fixed contacts 24, 25 and 26 is one element of a pole of the switch 11. Contacts 24, 25 and 26 are each engageable by a movable contact 35, 36 and 37, respectively. Each movable contact comprises a pair of contact blades such as the blades 35A and 35B of movable contact 35. Movable contacts 35, 36 and 37 are pivotally mounted upon electrical connector brackets 41, 43 and 45, respectively, by means of suitable pivot members 42, 44 and 46.

Switch 11 further includes an actuating bar 49 that extends transversely of the switch 11 and is connected to each of the movable contacts 35, 36 and 37 by means of a connecting linkage, which is not shown, so that pivotal movement of the actuating bar 49 with respect to the aligned pivot members drives the movable contacts of the switch to move pivotally into and out of engagement with the fixed contacts 24, 25 and 26. Switch 11 may be provided with appropriate overload fuses 50 and electrical lugs 51 to afford a means to complete electrical connections to the movable switch contacts.

Switch 11, as thus far described, corresponds in construction to the load-break, pressure-contact switch described and claimed in U.S. Pat. No. 3,213,247. The present invention is not directed to the switch structure per se and should not be construed as limited to use with the particular load switch shown and described in U.S. Pat. No. 3,213,247. The switch of this patent is merely illustrative of a number of different forms of switches in which the invention may be incorporated. Rather, the present invention pertains to an electrically non-conductive operating rod assembly for the switch contacts.

Likewise, operating mechanism 53 as shown and described corresponds in construction to the trip-free switch-operator mechanism described and claimed in U.S. Pat. No. 3,582,595. As stated in reference to the switch structure, the present invention is not directed to the switch operator mechanism per se and should not be construed as limited to use with the particular switch operator mechanism shown and described in U.S. Pat. No. 3,582,595.

The electrically non-conductive operating rod assembly 55 of this invention extends between the actuating bar 49 of the switch 11 and the switch-operator mechanism 53. At one end, the operating rod assembly connects to a bracket 57 attached to the actuating bar 49 and at its opposite end it connects to an operating lever 59 which is part of the switch operator mechanism 53.

The operating rod assembly 55 includes a metal rod 61 having threads 63 and 65 formed at opposite ends thereof. The threads 63 fit into a metal yoke 67 while the threads 65 engage a metal yoke 69. The yoke 67 is pivotally connected to one end of an insulator link 75 and the opposite end of the insulator link is pivotally connected to the bracket 57. The yoke 69 is pivotally connected to one end of a second insulator link 75 of similar construction and the opposite end of this second link is pivotally connected to the operating lever 59 of the switch operator mechanism 53.

The metal yoke 67 is connected to its insulator link 75 by a removable pivot pin 77 with the pivot pin extending through a passage 79 formed in the link. Shoulders 81 are formed in the link at the opposite ends of the passage 79 to increase the electrical clearance or path across the surface of the link. The opposite end of the link 75 is connected to the bracket 57 by means of a pivot pin 83 which extends through a passage 85 formed in the link. The pivot pin 83 has a circumferential groove 87 formed therein intermediate the ends thereof. A slot 89 formed in the link intersects the passage 85 and is aligned with the groove 87 in the pivot pin 83. A C-shaped locking ring or clip 91 fits into the groove 87 in the pivot pin 83 to lock the pivot pin and link relative to the bracket 57.

The metal yoke 69 is connected to its insulator link 75 by a pivot pin 77. The second insulator link 75 is connected to the operating lever 59 using a pivot pin 83 in the manner previously described.

The links 75 may be formed of any suitable dielectric material. Preferably, they are injection molded of a thermoplastic carbonate-linked polymer of the type sold under the trademark "LEXAN" by the General Electric Company.

In FIG. 1, the operating rod assembly 55 is shown in its upper or closed switch position. When the operating handle 95 of the switch operator mechanism 53 is turned in a clockwise direction, as viewed in FIG. 1, the operating lever 59 also rotates in a clockwise direction. Clockwise rotation of the operating lever 59 pulls the operating rod 61 downwardly to pivot actuating bar 49 outwardly and away from the insulating base 13. The pivotal movement of the bar 49 simultaneously pivots the movable contacts 35, 36 and 37 outwardly from the fixed contacts 24, 25 and 26 and thus opens the switch.

The number of poles in the switch 11, as well as the size of the contacts of the switch, may be varied for different applications. However, for all switches of this general kind, it is essential that the contacts separate rapidly and close rapidly in order to prevent excessive arcing, which would otherwise limit the contact life quite severely.

The basic function of the switch operator mechanism 53 is to apply the required force to rapidly close the switch 11. As explained above, it is actually the upward and downward angular movement of the operating lever 59 which brings about the closing and opening, respectively, of the switch 11.

Switch operator mechanism 53 is fixed in position in front of the switch 11. As disclosed in U.S. Pat. No. 3,582,595, operating lever 59 is rotatably mounted about a main drive shaft of the switch operator mechanism 53. The switch operator mechanism is equipped with an overcenter spring drive which is actuated when rotation of the main drive shaft is initiated in either the switch opening or switch closing position.

In addition to preventing the switch operator mechanism and operating handle 59 from becoming electrically charged, the operating rod assembly 55 of this invention, also compensates for any misalignment of the opening and closing mechanism since it allows the operator rod assembly to rotate slightly due to rotation of the metal rod 61 in the yoke 69 during opening and closing movement of the switch. The length of the operating rod assembly is adjustable prior to assembly. When the proper length is established, it is fixed by tightening the nut 73. The rod 61 is free to rotate only a few degrees relative to the yoke 69. This is sufficient to compensate for misalignment of the parts but will not substantially change the effective length of the operating rod assembly. The construction of the operating rod assembly also provides greater strength than has been obtained with conventional constructions while reducing the cost of manufacturing the operating rod assembly.

Whereas the preferred form of the invention has been described herein, it should be realized that there may be modifications, substitutions and alterations thereto all within the spirit and broad scope of the appended claims.

I claim:

1. In a high-current, low-voltage, load-break switch, of a kind comprising a fixed contact, a movable contact movable between a closed position in bolted pressure contact with the fixed contact and an open position displaced from the fixed contact, a switch-operator mechanism, including an operating lever, for rapidly opening and closing the switch by driving the movable contact between its closed position and its open position, and an electrically non-conductive operating rod assembly interconnecting the movable switch contact and the switch-operator mechanism, an improved operating rod assembly construction comprising:

a metal rod, threaded at its opposite ends;

two metal yokes, threaded onto the opposite ends of the metal rod to permit effective adjustment of the length of the operating rod assembly;

an insulator link, of molded high-strength dielectric material, pivotally mounted on one yoke at the end of that yoke opposite the rod to complete the operating rod assembly with a metal yoke at one end and the insulator link at the other;

and pivotal connecting means for pivotally connecting one end of the assembly to the movable switch contact and the other end to the operating lever of the switch-operator mechanism, said metal rod being freely rotatable relative to one metal yoke and adaptable to be locked rotationally relative to the other metal yoke.

2. The high-current, low-voltage, load-break switch of claim 1 in which the pivotal connecting means for pivotally connecting one end of the assembly includes a passage formed through said insulator link, a pivot pin extending through said passage and journalled at its ends in either the movable switch contact or the operating lever, a circumferential groove formed in said pivot pin intermediate its ends, a slot formed in said insulator link to intersect the passage with said slot positioned to align with said circumferential groove in said pivot pin, and a clip seated in said pivot pin circumferential groove to limit longitudinal movement of said pivot pin relative to said insulator link.

3. The high-current, low-voltage, load-break switch of claim 1 in which a second insulator link is pivotally mounted on the second metal yoke to provide an insulator link at each end of the operating rod assembly.

* * * * *